US006059316A

United States Patent [19]

Whittington

[11] Patent Number: 6,059,316

[45] Date of Patent: May 9, 2000

[54] PRODUCT CARRYING INSERT BOOK HAVING BOUND INSERT AND METHOD OF FORMING A BOOK

[75] Inventor: John L. Whittington, Crawfordsville, Ind.

[73] Assignee: R. R. Donnelley & Sons Company, Downers Grove, Ill.

[21] Appl. No.: 08/920,108

[22] Filed: Aug. 26, 1997

[51] Int. Cl.[7] ..... B42D 1/00

[52] U.S. Cl. ..... 281/38; 402/79; 206/308.1

[58] Field of Search ..... 281/38; 402/79; 206/308.1

[56] References Cited

U.S. PATENT DOCUMENTS

| | | | |
|---|---|---|---|
| 4,084,696 | 4/1978 | Katz . | |
| 5,031,772 | 7/1991 | Woodriff . | |
| 5,141,252 | 8/1992 | Michlin . | |
| 5,269,563 | 12/1993 | Michlin . | |
| 5,513,914 | 5/1996 | Faber . | |
| 5,579,908 | 12/1996 | Johnson . | |
| 5,590,912 | 1/1997 | Stevens | 283/56 |
| 5,595,798 | 1/1997 | Miller | 281/38 X |
| 5,713,605 | 2/1998 | Pace et al. | 281/38 |
| 5,782,349 | 7/1998 | Combs | 402/79 X |

FOREIGN PATENT DOCUMENTS 195 20 488 C1 9/1996 Germany .

*Primary Examiner*—Henry W. H. Tsai

*Attorney, Agent, or Firm*—Marshall, O'Toole, Gerstein, Murray & Borun

[57] ABSTRACT

In order to economically and effectively be capable of marketing a product with a book, an insert to be bound into the book comprises an envelope for carrying the product. The envelope has a first edge to be bound into the book and a sealed opening along a second edge for removing the product. The insert includes a barrier for isolating the product from the edge to be bound into the book. Also, a book having a plurality of pages bound into a cover along a spine edge can include the insert wherein the first edge is bound into the cover along with the pages. Further, a method of forming a book having the insert includes the step of providing the envelope along with a plurality of signatures each comprising a different plurality of pages. The signatures and the envelope are fed in a preselected order to a collating conveyor. Thereafter, a cover for each of the books is fed downstream of where the signatures and the envelope are fed and the signatures and the envelope are bound within the cover to complete the book.

17 Claims, 4 Drawing Sheets

PRODUCT CARRYING INSERT BOOK HAVING BOUND INSERT AND METHOD OF FORMING A BOOK

FIELD OF THE INVENTION

The present invention is generally related to inserts bound into books and, more particularly, an insert for carrying a product to be marketed with and bound into a book.

BACKGROUND OF THE INVENTION

In recent years, there has been a steady evolution in the techniques utilized in book binding. This has taken place in connection with many aspects of the book binding process in diverse areas from, for example, personalizing text within books to incorporating inserts into books during a machine book binding operation. Unfortunately, there have been difficulties encountered in binding inserts with automated equipment.

In particular, there have been various different attempts to bind inserts into books using automated equipment. There are added difficulties, however, when such inserts enclose or carry a product and, in particular, where they are utilized to carry a compact disc that is to be marketed with the book. More specifically, the only known manner of binding a compact disc into a book has involved considerable manual labor.

As will be appreciated, the manual labor has resulted in considerable cost that is detrimental in connection with marketing a compact disc with a book. It has simply not heretofore been possible to provide an insert or "carrier" for a compact disc which is compatible with existing binding equipment to run at maximum speed in a manner eliminating the possibility of crooked binding that might otherwise result in damage to the compact disc or machinery as well as an unacceptable appearance to the finished product. Accordingly, it has remained to provide a technique for binding a product into a book that eliminates the added expense of hand insertion.

The present invention is directed to overcoming one or more of the foregoing problems and achieving one or more of the resulting objects.

SUMMARY OF THE INVENTION

It is a principal object of the present invention to provide an insert to be bound into a book while carrying a product to be marketed with the book. It is a further object of the present invention to provide a book having a bound insert carrying a product to be marketed therewith. It is an additional object of the present invention to provide a method of forming a book having a bound insert carrying a product therewithin.

Accordingly, the present invention is directed to an insert to be bound into a book in the form of an envelope. The envelope carries a product to be marketed with the book and has a first edge to be bound into the book and a sealed opening along a second edge for removing the product. In addition, the insert includes means for isolating the product from the edge to be bound into the book.

In the exemplary embodiment, the envelope is formed of a single sheet folded at an intermediate point about a fold line at the edge to be bound into the book. Also, the sealed opening of the envelope is preferably defined by a glued flap which is preferably disposed opposite and generally parallel to the edge to be bound into the book. With this arrangement, the envelope includes a front panel and a rear panel and the product isolating means preferably includes a glue strip therebetween.

In the preferred embodiment, the insert includes a perforation defining means for separating the envelope carrying the product from the edge to be bound into the book. It is also advantageous for the envelope to include a window for the product which is located adjacent the sealed opening and is spaced from the edge to be bound into the book. Additionally, the insert preferably includes a perforation extending generally about the glue strip to make it possible to separate a portion of the envelope from the remainder thereof.

In another respect, the present invention is directed to a book having a bound insert carrying a product therewithin. The book includes a plurality of pages bound into a cover along a spine edge of the book and an envelope bound with the plurality of pages within the cover of the book. With this arrangement, the envelope is suited for carrying a product to be marketed with the book.

In addition, the book is such that the envelope has a first edge bound into the cover along the spine edge of the book. It also includes a separate, second edge comprising a sealed opening which is provided for removing the product from the envelope. Further, the envelope includes means for isolating the product from the first edge adjacent the sealed opening of the second edge.

In yet another respect, the present invention is directed to a method of forming a book having a bound insert carrying a product therewithin. The method includes the step of providing an envelope having a first edge which is to be bound into the book and a second edge which comprises a sealed opening with the product disposed therewithin. It also contemplates the envelope including means for isolating the product from the first edge while at the same time maintaining the product adjacent the sealed opening of the second edge. The method also includes the steps of providing a plurality of signatures each of which comprises a different plurality of pages of the book and feeding the signatures and the envelope in a preselected order to a collating conveyor. It also includes feeding a cover for each of the books at a point downstream of where the signatures and the envelope are fed. Still additionally, the method of forming a book includes the step of binding the signatures and the envelope within the cover to complete the formation of the book.

Other objects, advantages and features of the present invention will become apparent from a consideration of the following specification taken in conjunction with the accompanying drawings.

DETAILED DESCRIPTION OF THE PREFERRED EMBODIMENTS

Figure 1:
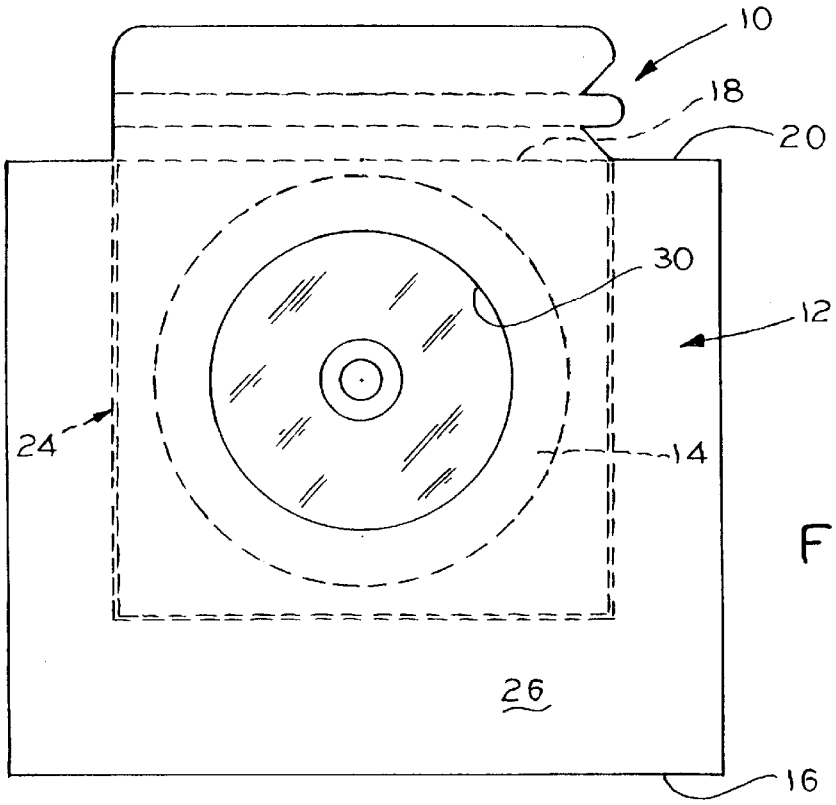
FIG. 1 is a top plan view of an insert to be bound into a book in accordance with the present invention.

In the illustrations given, and with reference first to FIG. 1, the reference numeral 10 designates generally an insert to be bound into a book in accordance with the present invention. The insert preferably takes the form of a generally rectangular envelope 12 for carrying a product such as a compact disc 14 to be marketed with a book. The envelope 12 has a first edge 16 to be bound into a book and a sealed opening as at 18 along a second edge 20 (see, also, FIG. 2). The sealed opening 18 of the envelope 12 is defined by a glued flap generally designated 22 opposite and parallel to the edge 16 to be bound into a book. The envelope 12 is formed of a single sheet folded at an intermediate point along a fold line at the edge 16 to be bound into a book. The insert 10 also includes means such as a glue strip as at 24 for isolating the compact disc 14 from the edge 16 to be bound into a book. Still additionally, and referring to FIGS. 1 and 2, the envelope 12 includes a front panel 26 and a rear panel 28 such that the glue strip 24 is disposed between the front panel 26 and the rear panel 28.

As will further be appreciated from FIG. 1, the envelope 12 preferably includes a window 30 through which the compact disc 14 can be viewed adjacent the sealed opening 18 and spaced from the edge 16 to be bound into a book.

Figure 3:
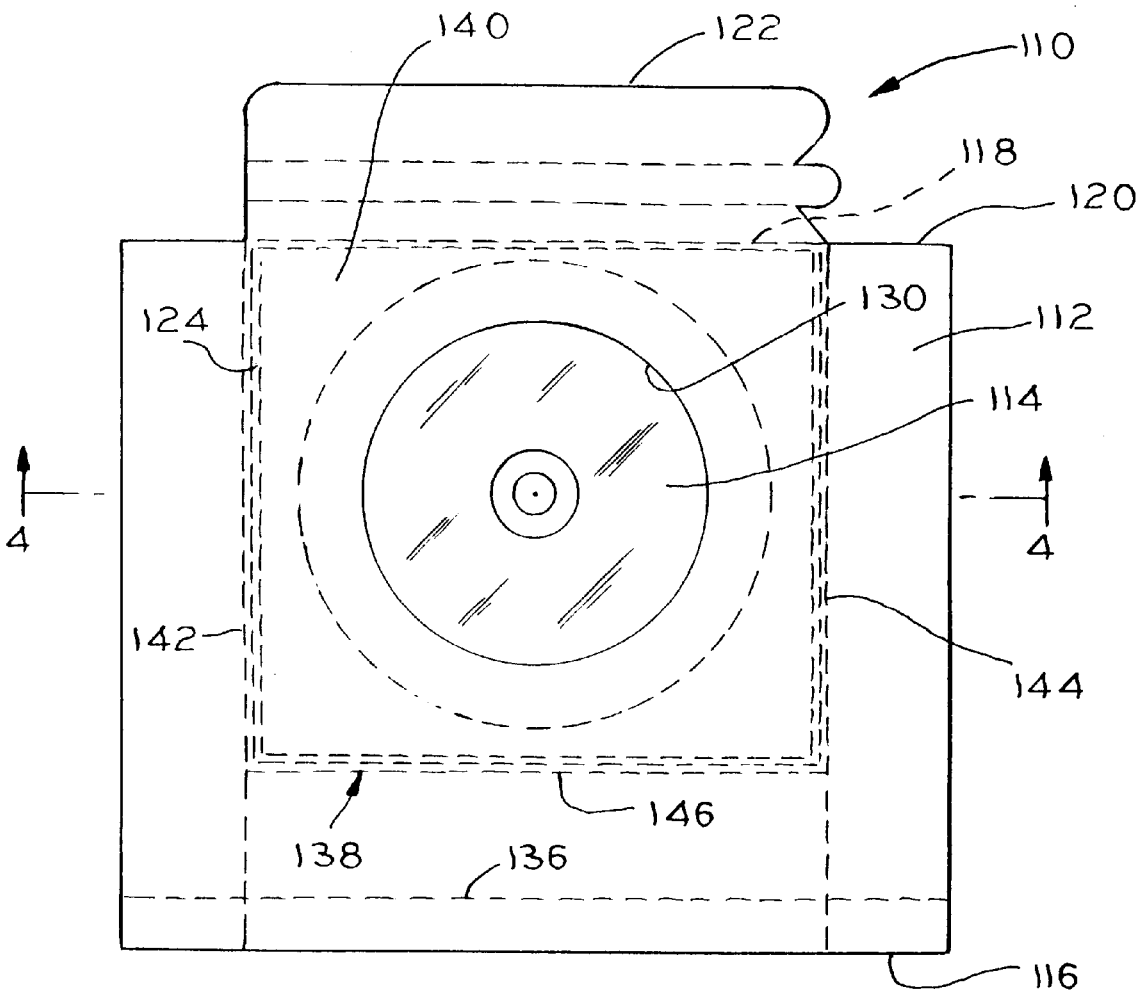
FIG. 3 is a top plan view of an alternative embodiment of insert in accordance with the present invention.
Figure 4:
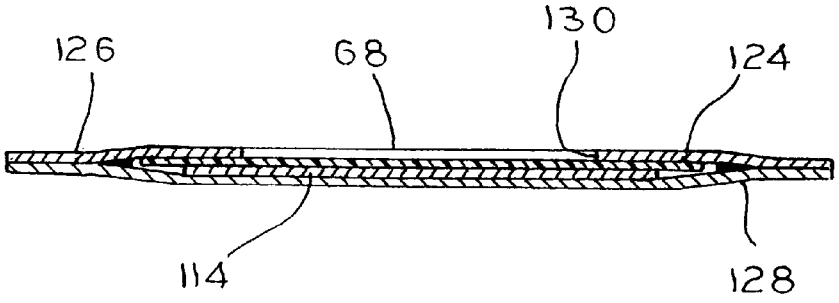
FIG. 4 is a cross-sectional view taken generally along the line 4—4 of the insert illustrated in FIG. 3.
Figure 5:
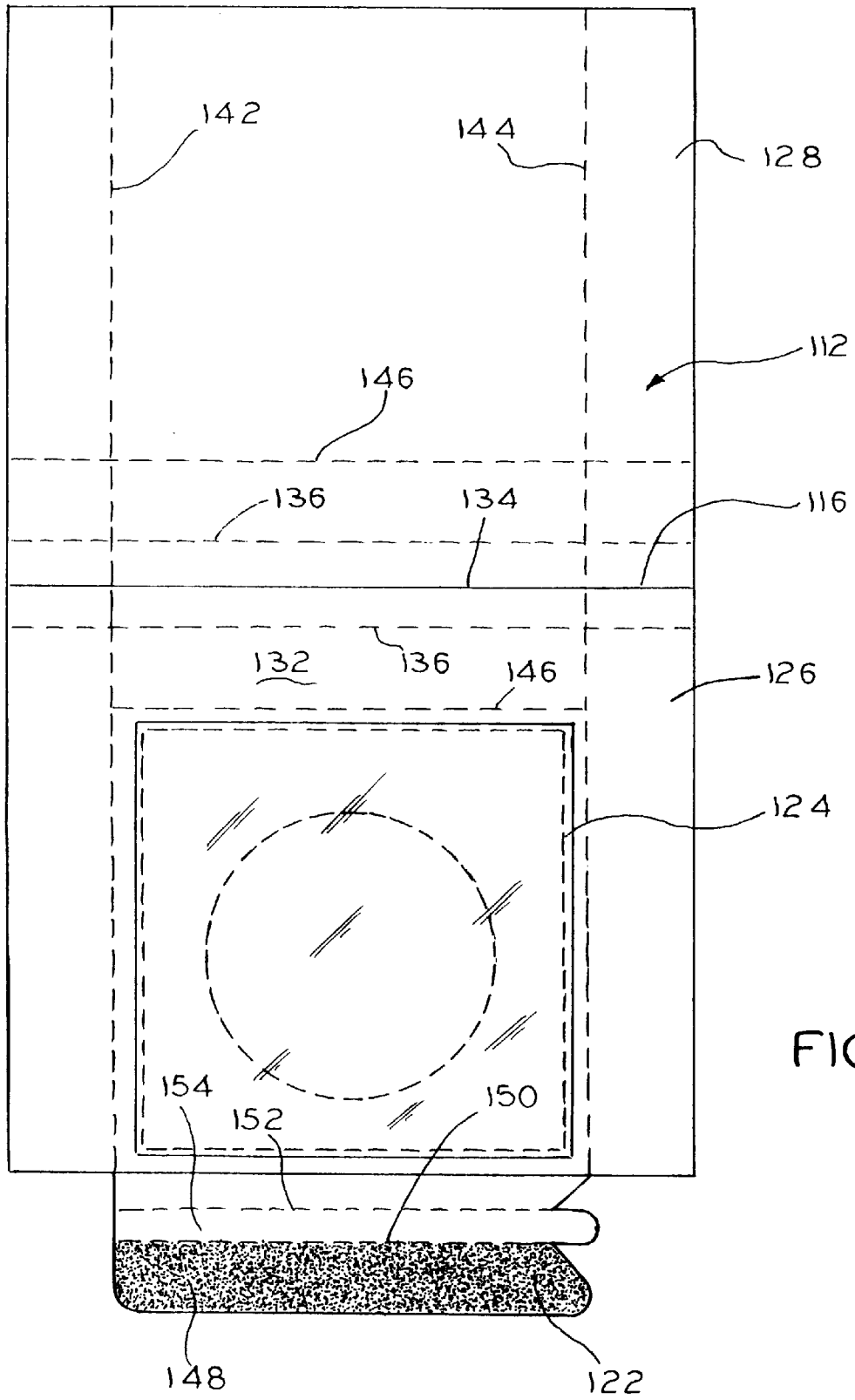
FIG. 5 is a top plan view of a single sheet that has been die cut in order to be folded into an insert.

Referring now to FIGS. 3–5, an alternative embodiment of insert generally designated 110 has been illustrated. The insert 110 also comprises a generally rectangular envelope 112 for carrying a compact disc 114 to be marketed with a book. The envelope 112 also has a first edge 116 to be bound into a book and a sealed opening as at 118 along a second edge 120. It will be appreciated especially from FIG. 5 that the envelope 112 is formed of a single sheet 132 folded at an intermediate point about a fold line 134 at the edge 116 to be bound into a book. The envelope 112 includes a front panel 126 and a rear panel 128 and means such as a glue strip 124 for isolating the compact disc 114 from the edge 116 to be bound into a book. The insert 110 is formed such that the glue strip 124 is disposed between the front panel 126 and the rear panel 128 (see FIG. 4). With this arrangement, the sealed opening 118 of the envelope 112 is defined by a glued flap 122 opposite and parallel to the edge 116 to be bound into a book.

Figure 2:
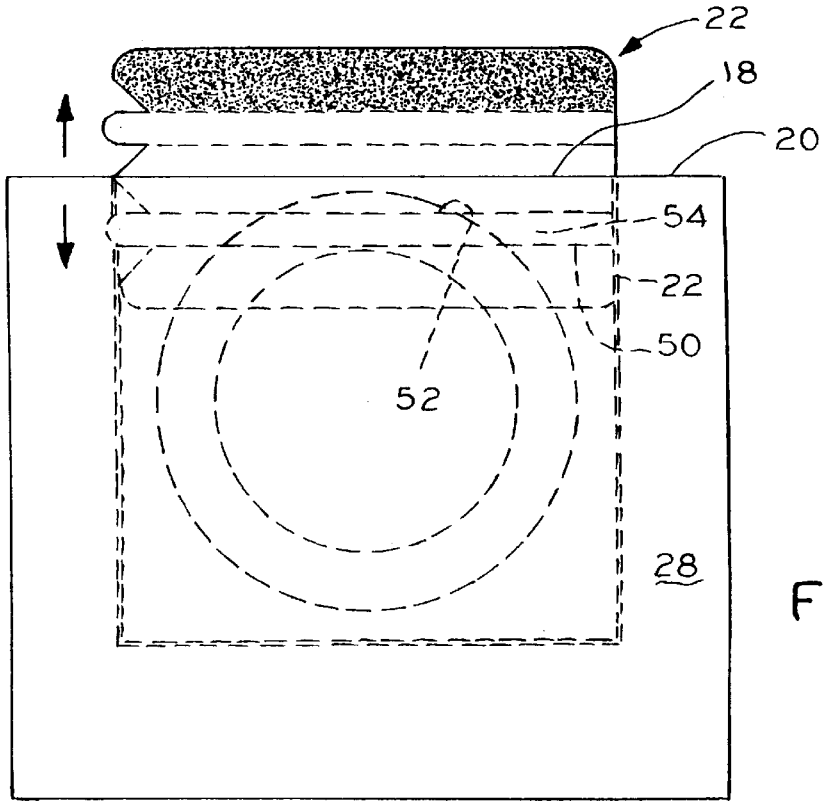
FIG. 2 is a bottom plan view of the insert of FIG. 1 showing the flap glued down in phantom lines.

As in the embodiment illustrated in FIGS. 1 and 2, the insert 110 includes a window 130 for viewing the compact disc 114 which is adjacent the sealed opening 118 and is spaced from the edge 116 to be bound into a book. It will also be seen that the insert 110 includes a perforation as at 136 for separating the envelope 112 carrying the compact disc 114 from the edge 116 to be bound into a book. Still additionally, the insert 110 includes a perforation as at 138 extending about the glue strip 124 for separating a portion 140 of the envelope 112 from the remainder thereof.

As illustrated, the perforation 138 includes lines of perforation as at 142 and 144 extending generally transversely of the perforation 136 and transversely of the edge 116 to be bound into a book. It will further be seen that the perforation 138 includes a line of perforation 146 extending transversely of the lines of perforation 142 and 144. In this manner, the portion 140 of the envelope 112 to be separated from the remainder of the envelope 112 comprises a small, generally rectangular compact disc carrying section of the envelope 112. Of course, it will be understood that the use and specific arrangement of perforations is optional depending upon the requirements for a particular customer for the product carrying insert 10.

Referring specifically to FIG. 5, the single sheet 132 can be die cut so as to be generally rectangular in shape while at the same time having the glued flap 122 formed integral therewith. It will be appreciated that the die cut can also form the opening defining the window 130 in the single sheet 132, and that perforating blades can make the various perforations 136, 142, 144, and 146 substantially as illustrated. As will be understood, the respective perforations 136, 142, 144, and 146 in the front and rear panels 126 and 128 will be in mating alignment once the single sheet 132 is folded about the fold line 134.

As also shown in FIG. 5, the glued flap 122 preferably is provided with glue as at 148 and has two parallel perforations as at 150 and 152 to define a tear-off strip 154. It will be appreciated that the glued flap 22, as shown in phantom lines in FIG. 2, can be similarly formed to include a pair of perforations 50 and 52 defining a tear-off strip 54. As with all of the other perforations, the perforations 50 and 52 as well as 150 and 152 can be formed by a suitable perforating blade in a manner that is well known in the art.

In another respect, the present invention is directed to a book 60 having a plurality of pages such as 62 bound into a cover 64 along a spine edge 66 and also having a bound insert such as 10 or 110 carrying a product such as a compact disc 14 or 114 therewithin. The bound insert such as 10 or 110 comprises an envelope such as 12 or 112 bound with the plurality of pages 62 within the cover 64 of the book 60 which carries the compact disc 14 or 114 to be marketed with the book 60. The envelope such as 12 or 112 has a first edge such as 16 or 116 bound into the cover 64 along the spine edge 66 of the book 60. The envelope such as 12 or 112 also has a separate, second edge such as 20 or 120 comprising a sealed opening such as 18 or 118 for removing the compact disc such as 14 or 114 from within the envelope. With this construction, the envelope such as 12 or 112 includes means in the form of a glue strip such as 24 or 124 for isolating the compact disc such as 14 or 114 from the first edge such as 16 or 116 adjacent the sealed opening such as 18 or 118 of the second edge such as 20 or 120.

As will be appreciated, the book 60 has been specifically illustrated as having a bound insert 110 carrying the compact disc 114, and it will likewise be appreciated that the envelope 112 is formed of a single sheet of material. The single sheet is folded at an intermediate point about a fold line at the edge 116 to be bound within the cover 64 and the sealed opening 118 of the envelope 112 is defined by a glued flap such as 122 illustrated in FIGS. 3 and 5 which is opposite and parallel to the edge 116 which is bound within the cover 64. As with the embodiment illustrated in FIGS. 3–5, the envelope 112 includes a window 130 for the compact disc 114 adjacent the sealed opening 118 and spaced from the edge 116 bound within the cover 64.

While not specifically shown, it will be understood that the insert 110 includes a perforation such as 136 for separating the envelope 112 carrying the compact disc 114 from the edge 116 to be bound into the book 60. It will also be appreciated that the envelope 112 will include a front panel such as 126 and a rear panel such as 128. Also, and as best shown in FIG. 3, the envelope 112 can advantageously include a perforation such as 138 extending about the glue strip 124 for separating a portion such as 140 of the envelope 112 from the remainder thereof.

Referring now to FIG. 4, the compact disc 114 is preferably protected by means of a flexible transparent material 68 covering the window 130 which permits the compact disc 114 to be viewed while at the same time preventing dirt and contaminants from entering into the interior of the envelope 112 after the glued flap 122 has been sealed to the rear panel 128. As a result, the compact disc 114 will be understood to be entirely confined between the front and rear panels 126 and 128 within the periphery defined by the glue strip 124 and the juncture between the front panel 126 and the glued flap 122 that is formed when the glued flap 122 is sealed to the rear panel 128.

Figure 7:
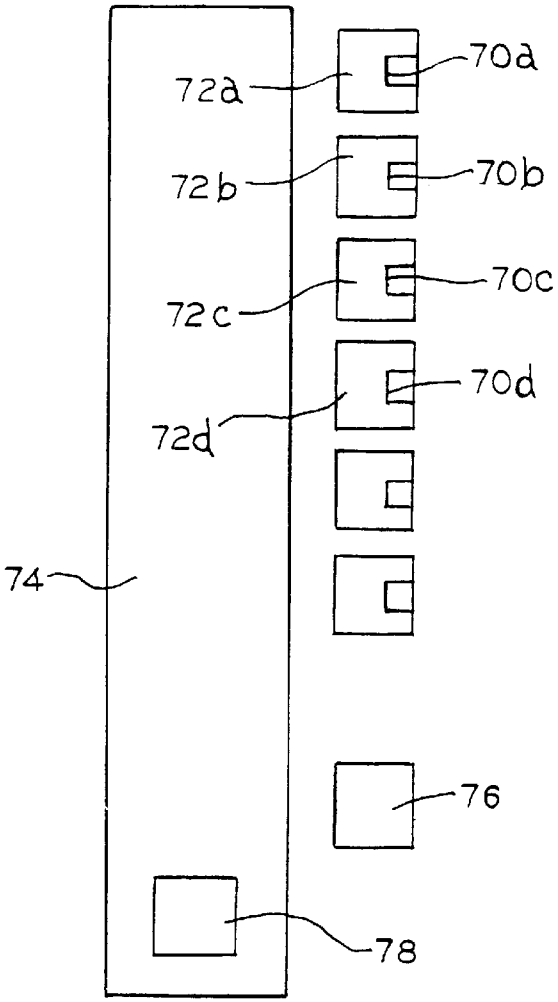
FIG. 7 is a schematic view of a method of forming a book having an insert in accordance with the present invention.
Figure 6:
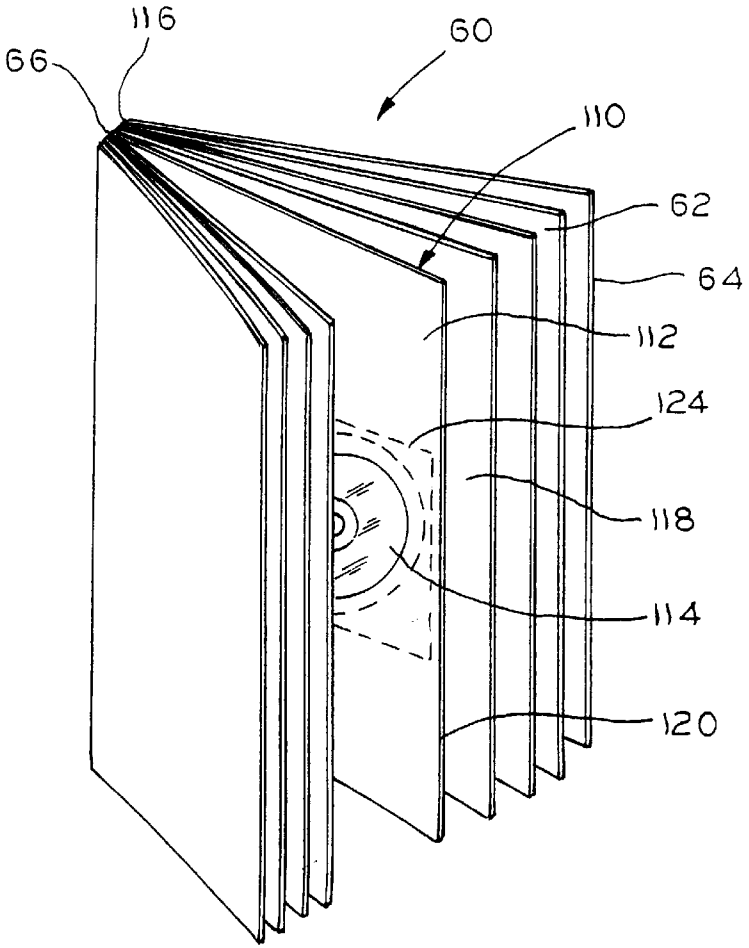
FIG. 6 is a perspective view of a book having therein a bound insert in accordance with the present invention.

Referring now to FIG. 7, the present invention is also directed to a method of forming a book such as 60 having a bound insert such as 110 carrying a product such as a compact disc 114. The method includes the step of providing an envelope 112 having a first edge 116 to be bound into the book 60 and a second edge 120 comprising a sealed opening 118 with the compact disc 114 therewithin. The envelope includes means such as a glue strip 124 for isolating the compact disc 114 from the first edge 116 while maintaining the compact disc 114 adjacent the sealed opening 118 of the second edge 120. The method also includes the step of providing a plurality of signatures as at 70*a*, 70*b*, 70*c*, 70*d*, etc. each of which comprises a different plurality of pages 62 of the book 60. The signatures provided as at 70*a*, 70*b*, 70*c*, 70*d*, etc. are fed by feeders such as 72*a*, 72*b*, 72*c*, 72*d*, etc. and the envelope 112 is also fed by one of such feeders, all in a preselected order, to a collating conveyor 74. In addition, the method includes the step of feeding a cover as at 76 for each of the books 60 downstream of where the signatures and the envelope are fed, i.e., downstream of 70*a*, 70*b*, 70*c*, 70*d*, etc.

Still additionally, the method includes the step of binding the signatures and the envelope within the cover as at 78 to complete the forming of the book.

With the foregoing understanding, the method also contemplates the envelope being formed by folding a single sheet of material at an intermediate point about a fold line at the edge to be bound into the book. It also contemplates the sealed opening of the envelope being formed by providing a glued flap opposite and parallel to the edge to be bound into the book. Additionally, the method contemplates a window for the compact disc being formed in the envelope adjacent the sealed opening and spaced from the edge to be bound into the book. It also contemplates forming a perforation for separating the envelope carrying the compact disc from the edge to be bound into the book. Still further, the method contemplates the envelope being formed to have a front panel and a rear panel and also contemplates forming a perforation extending about the glue strip for separating a portion of the envelope from the remainder thereof.

With all of the foregoing features and structure, the present invention significantly reduces the cost of affixing compact discs to books and improves the appearance of the finished product. It also permits the use of automated equipment that is standard on binding lines and, as such, significantly reduces the costs of utilizing this desirable new marketing technique. More specifically, the present invention eliminates the added expense of hand insertion of compact discs that has been necessarily required in the past in order to incorporate a product of this type into a book.

While in the foregoing there has been set forth a preferred embodiment of the invention, it will be appreciated that the details herein given may be varied by those skilled in the art without departing from the true spirit and scope of the appended claims.

I claim:

1. An insert to be bound in a book, comprising:

an envelope for carrying a product to be marketed with the book, the product having a peripheral edge, the envelope including a front panel and a rear panel;

said envelope having a first edge to be bound into the book and a sealed opening along a second edge for removing the product; and a glue strip disposed between the front and rear panels along a path located outside of the peripheral edge of the product, thereby to isolate the product from said edge to be bound into the book.

2. The insert of claim 1 wherein said envelope is formed of a single sheet folded at an intermediate point about a fold line at said edge to be bound into the book.

3. The insert of claim 1 wherein said sealed opening of said envelope is defined by a glued flap opposite and parallel to said edge to be bound into the book.

4. The insert of claim 1 wherein said envelope includes a window for the product adjacent said sealed opening and spaced from said edge to be bound into the book.

5. The insert of claim 1 including a perforation defining means for separating said envelope carrying the product from said edge to be bound into the book.

6. The insert of claim 1 including a perforation extending about said glue strip for separating a portion of said envelope from the remainder thereof.

7. An insert to be bound into a book, comprising:

a generally rectangular envelope for carrying a compact disc to be marketed with the book;

said envelope having a first edge to be bound into the book and a sealed opening along a second edge for removing the compact disc, said envelope being formed of a single sheet folded at an intermediate point about a fold line at said edge to be bound into the book; and means for isolating the compact disc from said edge to be bound into the book;

said envelope including a front panel and a rear panel and said isolating means including a glue strip disposed between said front panel and said rear panel.

8. The insert of claim 7 wherein said sealed opening of said envelope is defined by a glued flap opposite and parallel to said edge to be bound into the book.

9. The insert of claim 7 wherein said envelope includes a window for the compact disc adjacent said sealed opening and spaced from said edge to be bound into the book.

10. The insert of claim 7 including a perforation defining means for separating said envelope carrying the compact disc from said edge to be bound into the book.

11. The insert of claim 7 including a perforation extending about said glue strip for separating a portion of said envelope from the remainder thereof.

12. A book having a bound insert carrying a product, comprising:

a plurality of pages bound into a cover along a spine edge of the book;

an envelope bound with said plurality of pages within said cover of the book and carrying a product having a peripheral edge marketed with the book, said envelope having a first edge bound into said cover along the spine edge of the book and a separate, second edge comprising a sealed opening for removing the product from the envelope, said envelope including a front panel, a rear panel, and a glue strip disposed between the front and rear panels along a path located outside of the peripheral edge of the product, thereby to isolate the product from the first edge.

13. The book of claim 12 wherein said envelope is formed of a single sheet folded at an intermediate point about a fold line at said edge bound within said cover.

14. The book of claim 13 wherein said sealed opening of said envelope is defined by a glued flap opposite and parallel to said edge bound within said cover.

15. The book of claim 14 wherein said envelope includes a window for the product adjacent said sealed opening and spaced from said edge bound within said cover.

16. The book of claim 13 including a perforation defining means for separating said envelope carrying the product from said edge to be bound into the book.

17. The book of claim 12 including a perforation extending about said glue strip for separating a portion of said envelope from the remainder thereof.

* * * * *